US005360145A

United States Patent [19]

Gueret

[11] Patent Number: 5,360,145

[45] Date of Patent: Nov. 1, 1994

[54] DISPENSER FOR AT LEAST ONE LIQUID OR PASTY PRODUCT COMPRISING A CLOSURE SYSTEM THAT ALLOWS NO INGRESS OF AIR, AND PRESERVATION PROCESS USING THE SAID DISPENSER

[75] Inventor: Jean-Louis H. Gueret, Paris, France

[73] Assignee: L'Oreal, Paris, France

[21] Appl. No.: 82,358

[22] Filed: Jun. 28, 1993

[30] Foreign Application Priority Data

Jul. 21, 1992 [FR] France ..... 92 08976

[51] Int. Cl.[5] ..... B67D 5/58

[52] U.S. Cl. ..... 222/190; 222/95; 222/105; 222/207; 222/321; 222/494

[58] Field of Search ..... 222/145, 105, 107, 95, 222/207, 209, 215, 190, 321, 494; 523/122; 524/398, 399

[56] References Cited

U.S. PATENT DOCUMENTS 4,906,464 3/1990 Yamamoto et al. ..... 523/122 X
5,019,096 5/1991 Fox, Jr. et al. ..... 523/122 X
5,145,328 10/1992 Gueret ..... 222/494
5,165,952 11/1992 Solomon et al. ..... 523/122 X
5,236,703 8/1993 Usala ..... 523/122 X

FOREIGN PATENT DOCUMENTS 0410857 1/1991 European Pat. Off. .
58-64966 4/1983 Japan .

OTHER PUBLICATIONS

French Patent Office Search Report dated Mar. 16, 1993.

Patent Abstracts of Japan, vol. 13, No. 529, 27 Nov. 1989, Abstract of JP1215364 (Serutetsuku), Aug. 29, 1989, in English.

*Primary Examiner*—Gregory L. Huson
*Attorney, Agent, or Firm*—Staas & Halsey

[57] ABSTRACT

Dispenser for cosmetic or pharmaceutical products, including a container and a dispensing head attached to the container. The dispensing head includes a dispensing channel connecting the container to an external dispensing orifice. Part of the dispensing head, which defines the channel, is made of a synthetic polymer material and at least one of an antiseptic agent and an antioxidant agent.

18 Claims, 3 Drawing Sheets

DISPENSER FOR AT LEAST ONE LIQUID OR PASTY PRODUCT COMPRISING A CLOSURE SYSTEM THAT ALLOWS NO INGRESS OF AIR, AND PRESERVATION PROCESS USING THE SAID DISPENSER

BACKGROUND OF THE INVENTION

1. Field of the Invention

This invention concerns a dispensing device for at least one liquid, or a more or less thick pasty product, that makes it possible to dispense cosmetic or pharmaceutical products.

2. Description of the Related Art

It is known for dispensers to consist of a container holding the product to be dispensed and a dispensing head attached to the container and incorporating a channel that connects the container to an external dispensing orifice.

From EP-A 0 410 857, FR-A 2 660 877, FR-A 2 666 308 and the French patent application 91 06 097, it is known for this external dispensing orifice to be closed by a closure system comprising two elements: a stopper and a seating, at least one of these two elements being elastic. The two elements are in contact when no dispensing is taking place but move apart by elastic deformation of at least one of them under the pressure of the product being dispensed. The stopper may consist either of a lip that moves away from its seating by bending parallel to the direction in which the product is emerging, or of a membrane with a slot placed under constraint, or of a wedge on top of a flexible dome. The stopper is preferably made of an elastic material and is subjected to the action of a constraining body that tends to keep it pressed against the seating to which it conforms. The seating may also be elastic, but is more usually rigid.

The stopper-seating closure system may involve a dispensing head that is entirely fixed, the head being attached to a deformable container activated by the user, in which case the dispensing channel will consist of a rectilinear passage or may have various segments at an angle to one another. The dispensing head may comprise a pumping system that can be actuated by the user, and a second valve. In one version, the dispensing head with a pumping system may comprise, on the one hand, a fixed dispensing part attached to the container, which comprises a second valve able to close off the communication between the container and the dispensing channel, and on the other hand, a moving portion forming a pumping system activated by the user: the dispensing channel is then located between two valves, one attached to the container and the other attached to the moving portion of the dispensing head. In this version the dispensing channel comprises a pumping chamber that can be sealed off by the second valve, and a passage that connects the pumping chamber to the outside. In this version of the dispensing head the moving portion may be removable from the fixed part. In a different version, the dispensing head comprises a deformable part located opposite a chamber that the user presses to pump the product; in this case, the dispensing channel includes the pumping chamber and is also located between two valves. Various types of known dispensers to which the present invention can be applied, are illustrated in FIGS. 1 to 8 attached.

The stopper-seating closure system allows almost no ingress of air through itself. Consequently, the product remaining in the dispensing channel has practically no contact with air after being dispensed. This avoids much of the risk that the dispensed product might become degraded by contact with the air, either by oxidation or by microorganisms. It has been found, however, That the dispensed product may still become slightly degraded by oxidation or microorganisms, and that it may consequently lose some of its qualities.

SUMMARY OF THE INVENTION

The present invention concerns a dispenser in which this risk of degradation is eliminated, by making at least part of the surfaces of the dispensing head, with which the dispensed product is in contact while inside the dispensing channel, of a synthetic polymer material capable of releasing an antiseptic and/or antioxidant agent. The said material will be referred to hereinafter as the "aseptic material".

Thus, the subject of this invention is a dispenser for at least one liquid or pasty product, comprising a container for the product and a dispensing head with a dispensing channel that connects the container to an external dispensing orifice. The channel is fitted at the level of the dispensing orifice with a closure system that allows no ingress of air, comprising two elements: a stopper and its seating. At least one of those elements is made of an elastic material. The dispenser is characterized in that at least part of the surfaces of the dispensing head at the end of the dispensing channel is made of a synthetic polymer material capable of releasing at least one antiseptic agent and/or at least one antioxidant agent.

According to this invention, the product remaining inside the dispensing channel between two dispensations is in contact with the synthetic polymer material capable of releasing the antiseptic agent(s) and/or the antioxidant agent(s); the product is thus subjected to the action of these agents, and this prevents any degradation of the product dispensed by air oxygen or air impurities that might have made their way into the channel at the time of dispensing.

In the dispenser conforming to this invention, the dispensing head preferably comprises, a fixed part attached to the container, this fixed part comprising a valve that can close off the communication between the container and the dispensing channel, and a moving portion comprising a pumping system that can be actuated by the user. In this dispenser with two valves, namely the closure system itself and the valve in the fixed part, that part of the dispensing channel between the two valves contains none of the product before the first dispensation, and the product to be dispensed is thus not in contact with the antiseptic agent(s) and/or antioxidant agent(s) during storage, before the first dispensation. Thus, before the first dispensation, any action of the antiseptic(s) and/or antioxidant(s) during prolonged storage of the dispenser is avoided.

The moving portion of the dispensing head can, preferably be removed from the fixed part. This makes it possible to market refills consisting of the container and the fixed part of the dispensing head; refills to which the user can fit the removable portion of the dispensing head.

In accordance with this invention, it suffices for part of the surfaces of the dispensing head that form the dispensing channel to be made of an aseptic material, the said part being, preferably, located at the end of the dispensing channel, close to the dispensing orifice. When the dispensing head comprises a moving and a fixed portion, the surfaces made of aseptic material are, preferably, situated in that part of the dispensing channel located within the moving portion, constituting the end of the dispensing channel. For this purpose, the whole of at least one of the pieces forming the channel may be made of the aseptic material. It can be advantageous for the surface(s) made of aseptic material to form part of at least one insert in one of the components forming the channel.

According to the invention, the term 'antiseptic' is to be understood as any agent that can destroy or inhibit the development of microorganisms such as bacteria, microbes, molds or fungi. The antiseptic agent is preferably a water-soluble copper, zinc or silver salt, more particularly copper sulphate, zinc sulphate or silver sulphate. The antiseptic agents used in the aseptic material represent quantities ranging from 0.01 and 50% by weight of the synthetic polymer material. In effect, when the product is being used, the low mobility of the metallic ions used ensures that the quantity of ions dissolved in the composition dispensed represents an extremely low dose, of the order of magnitude generally used in homeopathy.

The antioxidant agent is preferably chosen from among the group consisting of gentisic, homogentisic, pidolic, ascorbic, or citric acids. For preference, the antioxidant is used in amounts ranging from 0.01 to 50% by weight relative to the weight of the synthetic polymer material.

The antiseptic agent(s) and/or antioxidant agent(s) may be incorporated directly in the material from which a component is fabricated, at least one surface of which defines the dispensing channel. The aseptic material are preferably introduced in the form of a support impregnated with the said agent(s). The support can be chosen from among porous products forming a group that comprises minerals such as silica, limestone, the zeolites and clays, or a group that comprises organic materials such as sawdust or powdered wood, starch or cellulose. The support may be in powdered or fibrous form, and is generally impregnated by immersion in an aqueous solution of the antiseptic and/or antioxidant agent(s), followed by drying. The impregnated support represents, preferably, 2 to 70% by weight of the synthetic material.

The antiseptic and antioxidant agent(s), whether or not absorbed into a support, may be incorporated in an elastic material, in particular that constituting the part of the dispensing head which forms the elastic stopper of the closure system, or, preferably, in a rigid material, in particular that constituting the part forming the seating of the closure system, when this is rigid. The said rigid material is preferably a thermosetting polymer, in particular a phenoplastic or aminoplastic resin, and more especially a urea-formaldehyde resin for the rigid parts. The elastic material is preferably an elastomer.

The present invention also concerns a preservation process for a liquid or pasty product that has to be protected against degradation by oxidation or by the action of microorganisms during the phase when the said product is being dispensed, characterized in that the said product is packaged in a dispenser as defined above.

BRIEF DESCRIPTION OF THE DRAWINGS

To make the subject of the invention more clear, several versions as shown on the attached drawings will be described below, as purely illustrative and non-limiting examples.

In the drawings:

FIGS. 1 to 6 show dispensers with airtight closures as described in EP-A 410 857.

DESCRIPTION OF THE PREFERRED EMBODIMENTS

Figure 1:
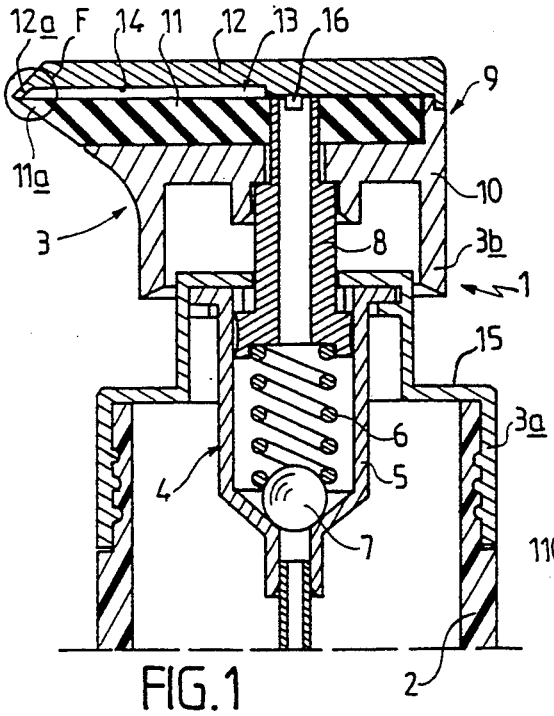
FIGS. 1 to 3 show longitudinal sections of three pump-type dispensers in which the closure system is a lip-type system.
Figure 1A:
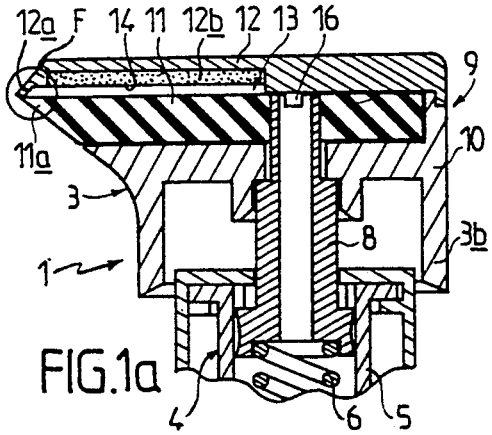
FIG. 1*a* is a variant of the dispenser in FIG. 1.

FIGS. 1 and 1*a* show a dispenser 1 with a container 2 holding the product to be dispensed and a dispensing head 3. The said head 3 consists of a fixed part 3*a* and a moving part 3*b*. The fixed part 3*a* consists of an attachment-piece 15 fixing the head 3 to the container 2 and a pump 4 attached to the container 2 by means of the attachment-piece 15. The pump body 5 contains a compressed spring 6 and communicates with the container 2 via a valve 7 whose ball is acted upon by the spring 6. The piston 8 of the pump 4 is hollow. To the piston 8 is attached a pushbutton 9, which enables the piston 8 to be pushed into the body of the pump 5 by manual pressure on the push-button 9. The hollow piston 8 of the pump 4 and the push-button 9 constitute the moving portion 3*b* of the dispensing head. The push-button 9 consists, in sequence, of a support 10 made of a rigid material, a lamina 11 made of an elastic material, and a cover 12 made of a rigid material. A groove 14 is formed in the cover 12. The dispensing channel 13 is demarcated by the body 5 of the pump 4, the hollow piston 8, the elastic lamina 11 and the cover 12. In the version shown, the piston 8 extends up to the cover 12 and a recess 16 formed in the upper edge of the piston 8 allows the bore of the piston 8 to communicate with the groove 14 or be cut off from it by rotating the push-button. The closure system F consists of a lip 11*a* consisting of the thin edge of the elastic lamina and by a seating 12*a* formed of a flat surface at the edge of the cover 12. According to this invention, the pump body 5, the piston 8 and the cover 12 are made of a urea-formaldehyde resin marketed by PERSTROP, containing 70% of cellulose as the filler; impregnated into this filler is a mixture (33:33:33) of copper sulphate and zinc sulphate as antiseptic agents, and citric acid as an antioxidant agent, using an aqueous solution saturated in these three constituents. The impregnation is followed by a drying phase. One could just as well have only the cover 12 made of a rigid plastic material containing and releasing an antiseptic and/or antioxidant, or only an insert 12*b* in the cover 12 made of aseptic urea-formaldehyde (see FIG. 1*a*). The product remaining inside the groove 14 after the dispensation is thus in contact with the aseptic material, and this avoids any risk that the said product will deteriorate.

Figure 2:
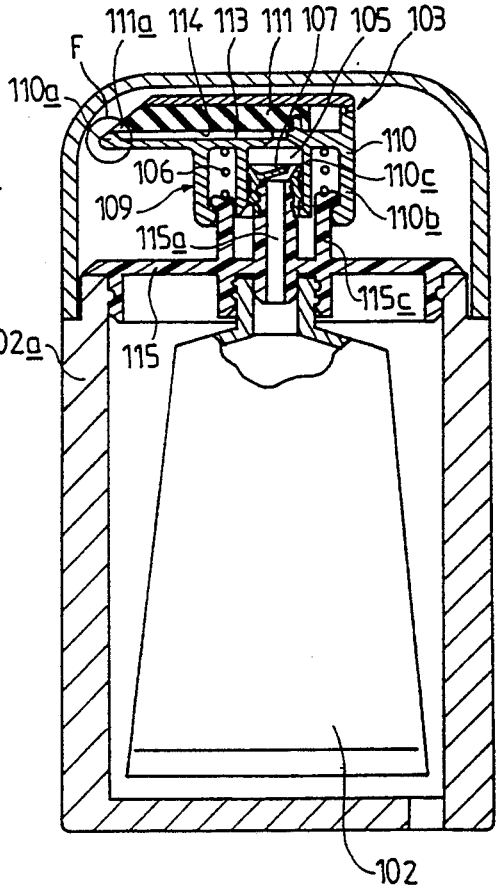

FIG. 2 shows a dispenser in which the closure system F consists of the lip 111*a* of a lamina 111 made of an elastic material, which rests against the seating 110*a* of a component 110 supporting the lamina 111. The container 102 is a flexible tube protected by a rigid casing 102*a*. The dispensing head 103 is fixed to the neck of the tube 102 by means of an attachment-piece 115 between the neck 102 of the tube and the edge of the rigid casing 102*a*. The push-button 109 slides along an axial track 115*a* closed off by a flap valve 107. The push-button 109 consists of the support 110 carrying the seating 110*a*, and the elastic lamina 111 carrying the stopper consisting of the lip 111*a*. A groove 114 is formed in the support 110. The support 110 has two concentric cylindrical skirts: 110*c* and 110*b*. The skirt 110*c*, of smaller diameter, makes a leakproof slide fit over the shaft 115*a* and so demarcates a pump body 105. A return spring 106 is located between the two skirts 110*c* and 110*b* between the push-button 109 and the upper edge of a skirt 115*c* of the attachment-piece. The dispensing channel 113 is demarcated by the shaft 115*a*, the pump body 105, the groove 114 and the lamina 111 opposite the said groove. In accordance with the invention, the support 110 is made of the same ureaformaldehyde resin as that described for the assembly (5, 8, 12) of FIG. 1. This avoids any degradation of the product remaining inside the groove 114 and the pump body 105 after dispensation.

Figure 3:
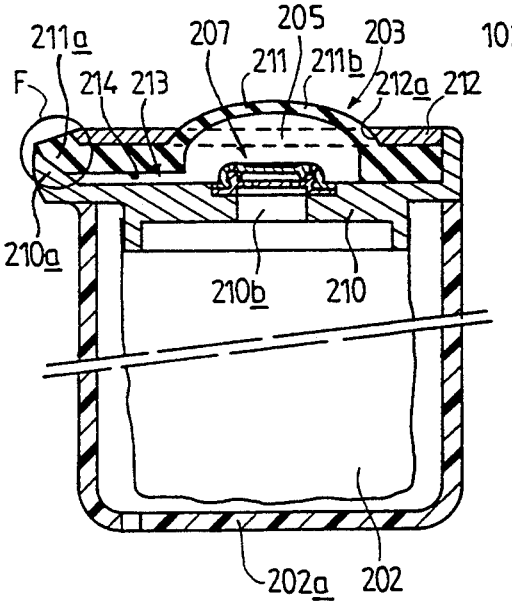

FIG. 3 shows a dispenser comprising a flexible container 202 inside a rigid casing 202*a*. The dispensing head 203 is attached to the flexible envelope 202 and to the container 202*a* by a support 210. This support incorporates the seating 210*a* of the closure device F. At its center there is an opening 210*b*, over which is fitted a bell-type non-return valve 207. A lamina 211 made of an elastic material and incorporating the stopper 211*a* rests against the support 210. At its center, the lamina 211 has a zone 211*b* that is thinner and dome-shaped. A groove 214 is formed in the lamina 211. Over the lamina 211 is fitted a cover 212 which serves to constrain the lamina and is provided with an opening 212*a* to allow the dome 211*b* of the lamina 211 to pass through. Thus, under the dome 211*b* there is a space forming a pump chamber 205 when the user presses the dome 211*b*. The dispensing channel 213 consists of the pump chamber 205 and the groove 214. In accordance with the invention, the support 210 is made of a resin as defined earlier for the support 110 of the version shown in FIG. 2.

Figure 4:
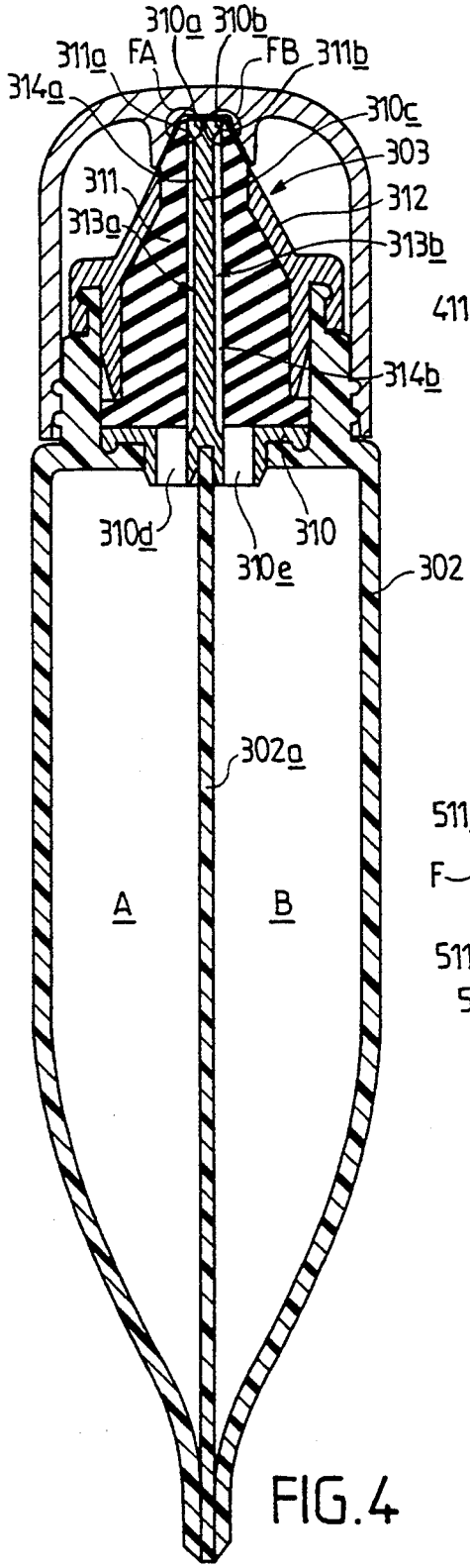
FIG. 4 is a dispenser with a flexible container activated by squeezing the flexible container.

FIG. 4 concerns a dispenser for two different products. It consists of a container 302 made of an elastic material and divided into two compartments A and B by a central partition 302*a*. A dispensing head 303 comprises a support 310 attached to the container 302 and the partition 302*a*. The base of the support 310 fitted to the container 302 has two openings 310*d* and 310*e*. The support 310 has a partition 310*c* forming an extension of the partition 302*a* and having two seatings 310*a* and 310*b* arranged symmetrically. Over the partition 310*c* is fitted, like the finger of a glove, a component 311 made of an elastic material in which two symmetrical grooves 314*a* and 314*b* are formed. Opposite the seatings 310*a* and 310*b*, the component 311 has thinned portions forming stoppers 311*a* and 311*b* so as to constitute closure systems FA and FB. The component 311 is surrounded by a cover 312 that acts to constrain the elastic component 311. The two dispensing channels 313*a* and 313*b* consist of the two openings 310*d*, 310*e* and the grooves 314*a* and 314*b*. In accordance with the invention, the support 310 is made of a resin such as that defined earlier for the support 110 of the version shown in FIG. 2.

Figure 5:
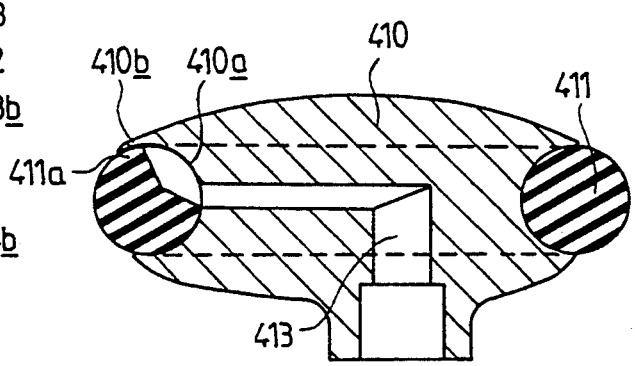
FIGS. 5 and 6 show dispensers in which the stopper consists of an elastic component, part of which is opposite the outlet of the channel and moves away from its rigid seating parallel to the flow direction of the product.

FIG. 5 shows a dispenser in which the stopper consists of an elastic component, one part of which is opposite the outlet of the dispensing channel. The dispensing head shown in FIG. 5 consists of an ovoid component 410, in which a channel 413 with two mutually perpendicular sections is formed. The ovoid component 410 has a peripheral groove 410*a* in which an elastic toroid 411 is inserted. At the level of the outlet of the channel 413, the component 411 has a recess forming a lip 411*a* that rests against a seating 410*b* consisting of a section of the groove 410*a*. Thus, the closure system F consists of the lip 411*a* and its seating 410*b*. In accordance with the invention, the ovoid component 410 is molded from a resin identical to that used for the support 110 in the version of FIG. 2.

Figure 6:
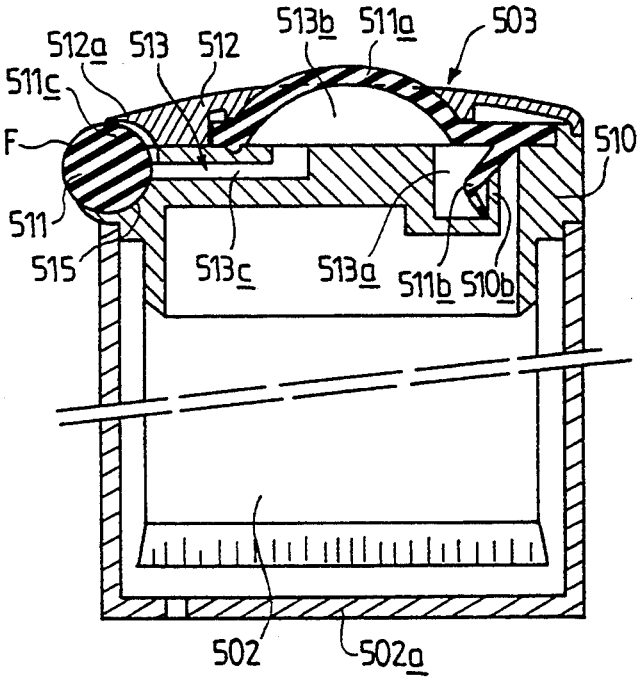

FIG. 6 shows a dispenser comprising a flexible tube 502 contained in a rigid casing 502*a*. To the edge of the rigid casing 502*a* is attached a dispensing head 503; the flexible tube 502 is fixed to a skirt forming part of the dispensing head 503. The dispensing head comprises a support 510 and a cover 512. The cover holds in place an elastic component 511, part of which 511*a* is dome-shaped while another part 511*b* cooperates with a partition 510*b* of the support 510 to form a first valve. The channel 513 thus has a first segment 513*a* close to the said first valve, a pump chamber 513*b* under the elastic dome 511*a* and a part 513*c* formed in the support 510. This part opens into a groove 515 formed both in the support 510 and the cover 512. A toroidal stopper 511 is inserted into the groove 515, so that the closure F consists of a section 511*c* of the stopper and the edge 512*a* of the groove 515 in the cover 512. In accordance with the invention, the support 510 is molded from a resin identical to that used for the support 110 of the version shown in FIG. 2.

Figure 7:
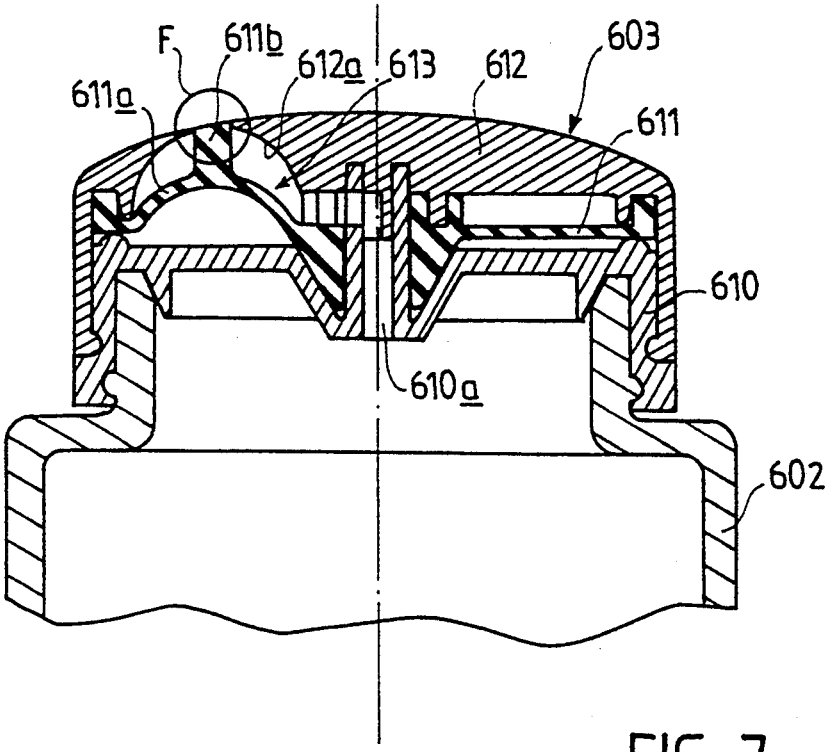
FIGS. 7 and 8 show a dispenser in which the stopper consists of a wedge on a flexible dome.
Figure 8:
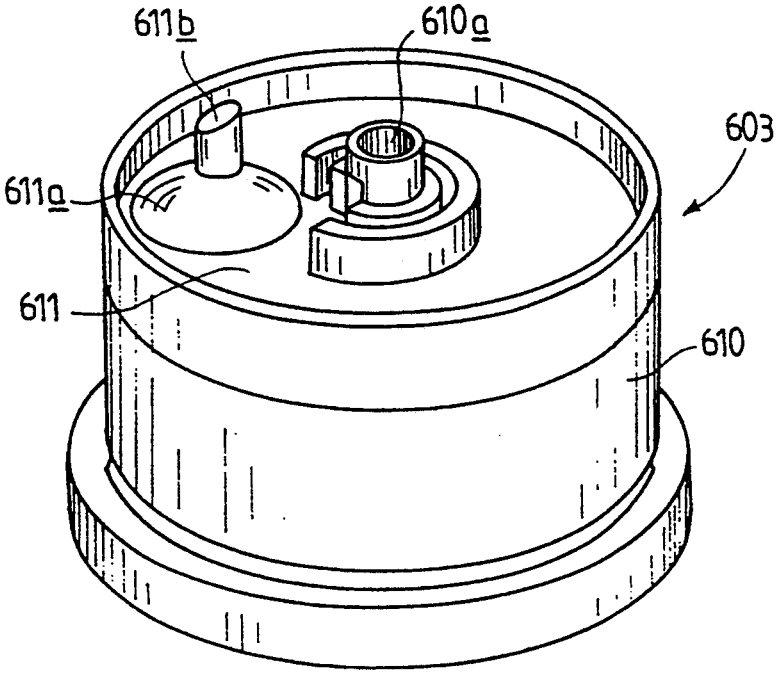

FIGS. 7 and 8 show a dispenser such as that described in FR-A 2 660 877 in which the closure device F consists of a wedge fitted on a flexible dome, such that the wedge cooperates with a rigid border. The dispenser consists of a container 602 to which a dispensing head 603 is attached while able to rotate. This dispensing head 603 consists of a support 610, a cover 612, and an elastic component held between the support 610 and the cover 612. The elastic component 611 comprises a dome-shaped area 611*a* on which there is a wedge 611*b* which passes through an opening 612*a* in the cover. The dispensing channel 613 consists of a shaft 610*a* of the support with an internal bore, and a zone located between the cover and the elastic component 611. The closure system F is formed by the wedge 611*b* which cooperates with the edge of the opening 612*a* in the cover. In accordance with the invention, the cover is molded from a resin such as that defined for the support 110 in the version of FIG. 2.

I claim:

1. Dispenser for at least one of a liquid and pasty product, comprising:

(a) a container holding the product; and (b) a head for dispensing the product, said head having a dispensing channel that connects the container to an external dispensing orifice, the channel being provided, at the dispensing orifice, with a closure system that allows substantially no ingress of air, wherein the dispensing head includes an inserted part positioned adjacent the dispensing channel and defining at least a portion of the dispensing channel, said part being made of synthetic polymer material and including at least one of an antiseptic agent and an antioxidant agent which contacts the product, when the product is in the dispensing channel, to prevent degradation of the product in the dispensing channel.

2. Dispenser according to claim 1, wherein the dispensing head comprises a fixed portion attached to the container, a valve that cuts off communication between the container and the dispensing channel, and a moving portion including a pumping system actuated by the user.

3. Dispenser according to claim 2, wherein the moving portion of the dispensing head is removable.

4. Dispenser according to claim 1, wherein the part of the dispensing head is located at an end of the dispensing channel, close to the dispensing orifice.

5. Dispenser according to claims 1, 2, 3, or 4, wherein the antiseptic agent is a water-soluble salt of at least one of zinc, copper and silver.

6. Dispenser according to claim 5, wherein the salt is a sulphate salt.

7. Dispenser according to claims 1, 2, 3, or 4, wherein the antioxidant agent is at least one of a gentistic, homogentisic, pidolic, ascorbic and citric acids.

8. Dispenser according to claim 5, wherein the antiseptic agent represents 0.01 to 50% by weight relative to the weight of the synthetic polymer material.

9. Dispenser according to claim 7, wherein the antioxidant agent represents 0.01 to 50% by weight relative to the weight of the synthetic polymer material.

10. Dispenser according to claim 9, wherein the at least one antiseptic agent and antioxidant agent is incorporated directly in the synthetic polymer material.

11. Dispenser according to claim 1, wherein the at least one of an antiseptic and an antioxidant agent is impregnated in a support.

12. Dispenser according to claim 11, wherein the impregnated support is at least one of saw dust, powdered wood, starch, cellulose, silica, zeolite and clay.

13. Dispenser according to claims 11 or 12, wherein the impregnated support represents 2 to 70% by weight of the synthetic polymer material.

14. Dispenser according to claim 1, wherein the part is an elastic material.

15. Dispenser according to claim 1, wherein the part is a thermosetting polymer.

16. Dispenser according to claim 15, wherein the thermosetting polymer is an aminoplastic resin.

17. Dispenser according to claim 16, wherein the aminoplastic resin is a urea-formaldehyde resin.

18. Dispenser according to claim 15, wherein the thermosetting polymer is a phenoplastic resin.

* * * * *